US009288582B2

(12) United States Patent
Vieites et al.

(10) Patent No.: US 9,288,582 B2
(45) **Date of Patent: *Mar. 15, 2016**

(54) SUSPENSION SYSTEM FOR MICRO-SPEAKERS

(71) Applicant: Apple Inc., Cupertino, CA (US)

(72) Inventors: Pablo Seoane Vieites, Sunnyvale, CA (US); Suzanne Hardy, San Jose, CA (US); Christopher R. Wilk, Los Gatos, CA (US); Alexander V. Salvatti, Morgan Hill, CA (US); Scott P. Porter, Cupertino, CA (US); Justin D. Crosby, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/612,872

(22) Filed: Feb. 3, 2015

(65) Prior Publication Data

US 2015/0146911 A1 May 28, 2015

Related U.S. Application Data

(63) Continuation-in-part of application No. 13/954,382, filed on Jul. 30, 2013.

(51) Int. Cl.
*H04R 1/00* (2006.01)
*H04R 9/04* (2006.01)

(52) U.S. Cl.
CPC ..... *H04R 9/043* (2013.01); *H04R 2400/03* (2013.01); *H04R 2499/15* (2013.01)

(58) Field of Classification Search
CPC ..... H04R 2400/03; H04R 2400/07; H04R 2499/11–2499/15; H04R 2207/021; H04R 1/2823; H04R 7/04; H04R 9/025; H04R 31/006; H04R 9/06; H04R 2400/11; H04R 31/003; H04R 9/047; H04R 7/20
USPC ..... 381/398, 301, 306, 333, 334, 388, 403; 181/171, 166, 172
See application file for complete search history.

(56) References Cited

U.S. PATENT DOCUMENTS 4,967,871 A * 11/1990 Komatsubara ..... H04R 9/066 181/141
6,850,138 B1 * 2/2005 Sakai ..... H04R 9/025 335/222

(Continued)

FOREIGN PATENT DOCUMENTS

KR 101096788 12/2011
WO WO-2012093058 7/2012

OTHER PUBLICATIONS

Non-Final Office Action dated Feb. 17, 2015, U.S. Appl. No. 13/954,382.

(Continued)

*Primary Examiner* — Sunita Joshi
(74) *Attorney, Agent, or Firm* — Blakely, Sokoloff, Taylor & Zafman LLP

(57) ABSTRACT

A speaker driver including a frame and a magnet assembly positioned within the frame. A sound radiating surface may be suspended over the magnet assembly. The sound radiating surface may include a top face and a bottom face, and the bottom face may face the magnet assembly. A suspension member may suspend the sound radiating surface over the magnet assembly. The suspension member may include a top side connected to the bottom face of the sound radiating surface and a bottom side connected to assembly support member that is separate from the magnet assembly. A voice coil extends from the bottom face of the sound radiating surface.

20 Claims, 8 Drawing Sheets

(56) References Cited

U.S. PATENT DOCUMENTS

| | | | | |
|---|---|---|---|---|
| 8,150,076 | B2 * | 4/2012 | Jeong | H04M 1/035 381/152 |
| 8,247,930 | B2 | 8/2012 | Yamagishi | |
| 8,295,538 | B2 | 10/2012 | Harris et al. | |
| 2012/0170778 | A1 | 7/2012 | Wei | |
| 2012/0263338 | A1 | 10/2012 | Hori et al. | |
| 2013/0016874 | A1 | 1/2013 | Huang et al. | |

OTHER PUBLICATIONS

Final Office Action dated Jun. 19, 2015, U.S. Appl. No. 13/954,382.

* cited by examiner

SUSPENSION SYSTEM FOR MICRO-SPEAKERS

CROSS-REFERENCE TO RELATED APPLICATION

This application is a continuation-in-part of application Ser. No. 13/954,382, filed Jul. 30, 2013 and incorporated herein by reference.

FIELD

An embodiment of the invention is directed to a speaker assembly suspension system for low rise micro-speakers. Other embodiments are also described and claimed.

BACKGROUND

In modern consumer electronics, audio capability is playing an increasingly larger role as improvements in digital audio signal processing and audio content delivery continue to happen. There is a range of consumer electronics devices that are not dedicated or specialized audio playback devices, yet can benefit from improved audio performance. For instance, smart phones are ubiquitous. These devices, however, do not have sufficient space to house high fidelity speakers. This is also true for portable personal computers such as laptop, notebook, and tablet computers, and, to a lesser extent, desktop personal computers with built-in speakers. Such devices typically require speaker enclosures or boxes that have a relatively low rise (i.e. height or thickness as defined along the z-axis), as compared to, for instance, stand alone high fidelity speakers and dedicated digital music systems for handheld media players.

SUMMARY

An embodiment of the invention is a speaker assembly (e.g. a speaker driver) including a frame, a magnet assembly, a sound radiation surface, a suspension member and a voice coil. The magnet assembly is positioned within the frame and the sound radiating surface is suspended over the magnet assembly by the suspension member. The suspension member may have a top side connected to a bottom face of the sound radiating surface and a bottom side connected to a support member such that it extends in the z-height direction of the speaker driver. The voice coil may extend from the bottom face of the sound radiating surface such that it is aligned with a magnetic flux gap formed within the magnet assembly. The suspension member may be resilient such that it can expand and contract in the z-height direction in response to movement of the sound radiating surface. In addition, the suspension member may be confined to an area below the sound radiating surface and within a footprint of the sound radiating surface such that it does not extend radially beyond the perimeter of the sound radiating surface. In this aspect, an acoustic radiation surface area of the sound radiating surface may be improved, e.g., increased.

In some embodiments, the speaker assembly may be a micro-speaker assembly which is integrated within a portable audio device. In this aspect, an acoustic output port of the speaker assembly may be aligned with an acoustic opening of the portable audio device such that sound generated by the speaker assembly may be output from the portable audio device.

The above summary does not include an exhaustive list of all aspects of the embodiments disclosed herein. It is contemplated that the embodiments may include all systems and methods that can be practiced from all suitable combinations of the various aspects summarized above, as well as those disclosed in the Detailed Description below and particularly pointed out in the claims filed with the application. Such combinations may have particular advantages not specifically recited in the above summary.

BRIEF DESCRIPTION OF THE DRAWINGS

The embodiments disclosed herein are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments with reference to the appended drawings. Whenever the shapes, relative positions and other aspects of the parts described in the embodiments are not clearly defined, the scope of the embodiments is not limited only to the parts shown, which are meant merely for the purpose of illustration. Also, while numerous details are set forth, it is understood that some embodiments may be practiced without these details. In other instances, well-known structures and techniques have not been shown in detail so as not to obscure the understanding of this description.

Figure 1A:
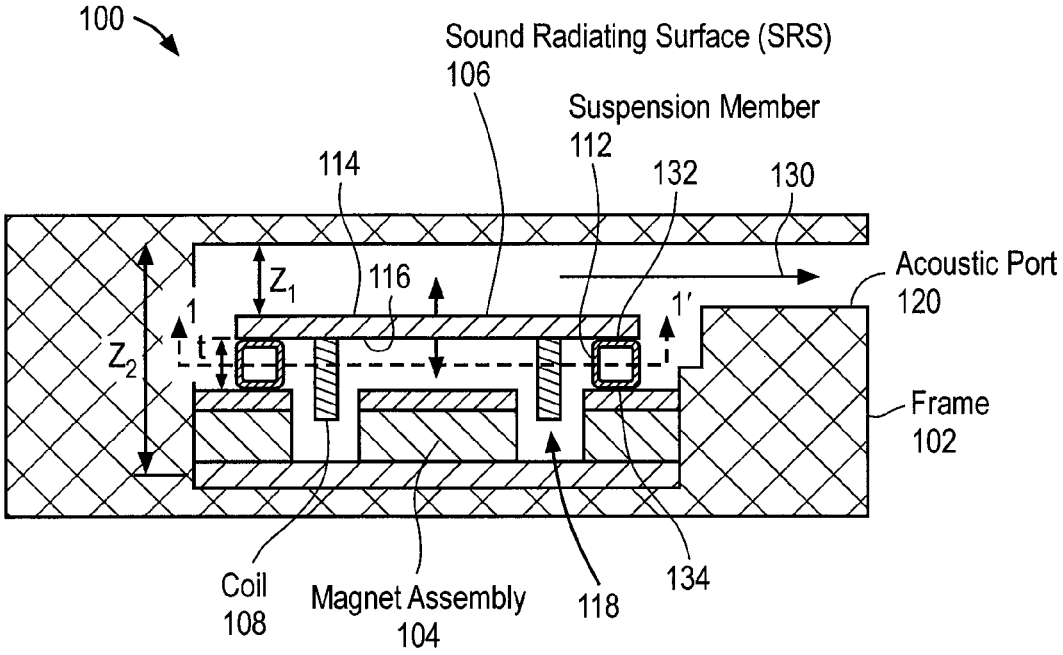
FIG. 1A is a cross-sectional side view of an embodiment of a speaker assembly.
Figure 6:
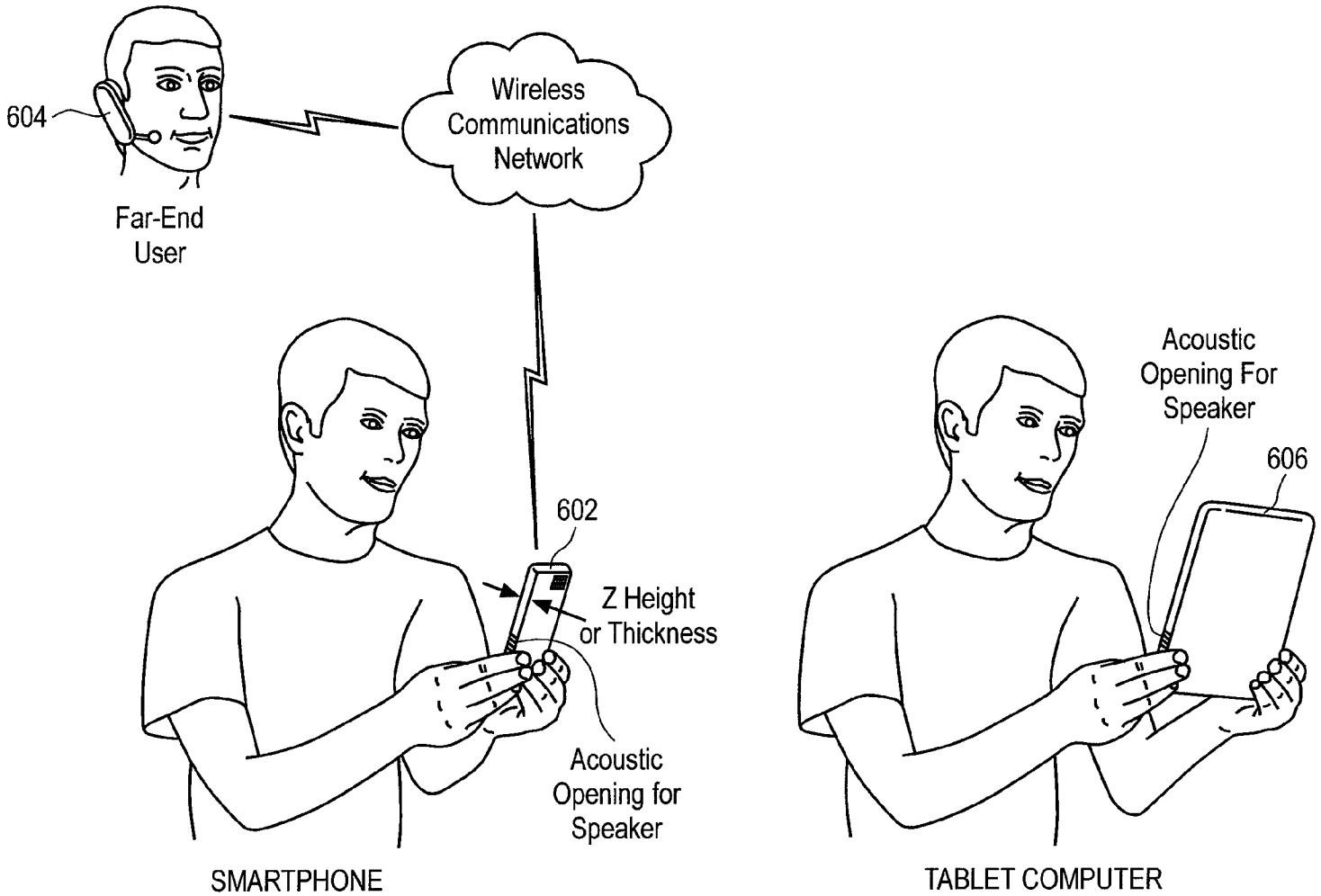
FIG. 6 depicts two instances of consumer electronics devices that typically specify low rise speakers in which the speakers disclosed herein may be implemented.

FIG. 1A is a cross-sectional side view of an embodiment of a speaker assembly. Speaker assembly 100 may be any type of electroacoustic transducer or driver that produces sound in response to an electrical audio signal input. Representatively, in one embodiment, speaker assembly 100 may be a micro-speaker. Speaker assembly 100 is built into frame 102, which may be of a typical material used for speaker enclosures, such as plastic. Frame 102 may include an acoustic port 120 for output of sound from speaker assembly 100 in the direction illustrated by arrow 130. In the illustrated embodiment, frame 102 includes acoustic port 120 along its side such that speaker assembly 100 may be considered "side firing", meaning that sound is output in a sideways direction as illustrated by arrow 130. Frame 102 may be part of, or mounted within, an electronic device enclosure whose z-height (or rise or thickness) is considered to be relatively small. For example, the enclosure z-height may be in the range of about 8.5 millimeters (mm) to about 10 mm. The concepts described herein, however, need not be limited to speaker enclosures whose height is within these ranges. As seen in FIG. 6, such a speaker assembly 100 may be a speakerphone unit that is integrated within a consumer electronic device 602 such as a smart phone with which a user can conduct a call with a far-end user of a communications device 604 over a wireless communications network; in another example, the speaker assembly 100 may be integrated within the housing of a tablet computer 606. These are just two examples of where the speaker assembly may be used.

Speaker assembly 100 may include a magnet assembly 104, sound radiating surface (SRS) 106 and coil 108 (also referred to as a voice coil). SRS 106 may be any type of speaker or micro-speaker diaphragm capable of inter-converting mechanical motion and sound. Coil 108 may be attached to a bottom face 116 of SRS 106 in any suitable manner, e.g., chemical bonding, mechanically attached or the like. Coil 108 may be any type of voice coil suitable for use in a speaker, for example, a micro-speaker. Magnet assembly 104 may define a magnetic flux gap 118 within which a portion of coil 108 may be positioned. A magnetic field of magnet assembly 104 helps to drive an up and down movement of coil 108, which in turn vibrates or moves SRS 106 in a similar manner with respect to magnet assembly 104 (as illustrated by arrows) to generate sound waves.

SRS 106 may be movably suspended over magnet assembly 104 by a suspension member 112. Suspension member 112 may be positioned between the bottom face 116 of SRS and magnet assembly 104 such that it suspends SRS 106 above magnet assembly 104. In addition to facilitating vibration of SRS 106 back and forth as illustrated by the arrows, suspension member 112 helps to maintain side to side alignment of coil 108 within gap 118.

In some embodiments, suspension member 112 is dimensioned to suspend a resilient portion of SRS 106 above magnet assembly 104 without extending into an area above top face 114 of SRS 106 (i.e. the area between top face 114 and the top wall of frame 102). In this aspect, a z-height between top face 114 of SRS 106 and frame 102 (illustrated as $Z_1$), and in turn an overall z-height of frame 102 (illustrated as $Z_2$) need not be increased to accommodate suspension member 112. As such, a z-height of speaker assembly 100 can be reduced, as compared to speakers using radially extending half-arc suspension systems that extend above the diaphragm they are suspending. Consider for example a typical speaker assembly having a $Z_1$ to $Z_2$ height ratio of about 1 to 5, speaker assembly 100 may allow for this ratio to be reduced such that $Z_1$ to $Z_2$ is, for example, from about 1 to 4, or from 1 to 3, or 1 to 2. The reduced z-height of speaker assembly 100 allows speaker assembly 100 to be integrated within relatively low rise devices.

In addition to not extending above SRS 106, suspension member 112 is substantially confined to an area below SRS 106, in other words SRS 106 overlaps suspension member 112. Described another way, suspension member 112 is substantially within a footprint of SRS 106 such that it does not extend radially beyond a perimeter of SRS 106. In this aspect, the acoustic radiation surface area of SRS 106 is improved (i.e. increased). The acoustic radiation surface area generally refers to the surface area of SRS 106 which can vibrate and produce sound. Representatively, the area of the frame within which a typical SRS is supported has a predefined length and width. When the SRS is suspended within the frame using a suspension system that extends radially from the SRS to the frame (e.g. a half-arc suspension system), the overall area of the SRS must be reduced to accommodate the surrounding suspension system. Since suspension member 112, however, does not extend radially beyond a perimeter of SRS 106, the acoustic radiation surface area of SRS 106 does not need to be reduced to accommodate suspension member 112. Rather, SRS 106 can extend into the area of frame 102 typically reserved for a radially extending suspension member thereby increasing its acoustic radiation surface area. In addition, because suspension member 112 extends vertically between SRS 106 and magnet assembly 104, SRS 106 has a higher stiffness in the in-plane direction, as compared to diaphragms suspended using radially extending suspensions. This in turn helps to stabilize SRS 106 displacement and minimize rocking or tilting of SRS 106.

Suspension member 112 can be any size, shape and/or material suitable for suspending SRS 106 above magnet assembly 104 in the manner previously discussed. Representatively, suspension member 112 may be made of any structure and/or materials which allow suspension member 112 to be contracted down to the excursion limit of SRS 106, with the excursion limit being one which avoids coil 108 from contacting frame 102. In addition, the structure and/or material of suspension member 112 should be that which allows maximal and symmetrical displacement of SRS 106 in the upward direction so as to minimize rocking of SRS 106. In this aspect, suspension member 112 should be resilient and capable of expanding and contracting along the z-height direction to accommodate SRS movement with respect to magnet assembly 104. Representatively, suspension member 112 may be made of a resilient material including, but not limited to, silicone, rubber, or a gel material encapsulated within any of these materials, or any combination of these materials. In some embodiments, suspension member 112 is made of any non-metal material.

Figure 1B:
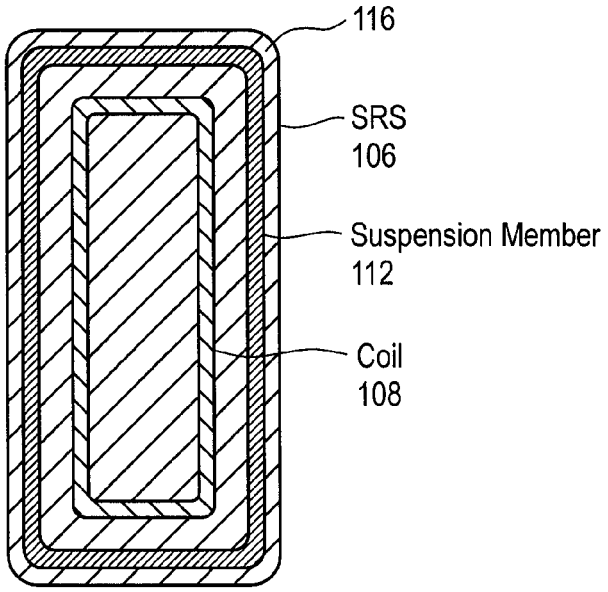
FIG. 1B is a bottom plan view of the sound radiating surface of one embodiment of the speaker assembly along line 1-1' of FIG. 1A.

In one embodiment, suspension member 112 may be an elongated structure which is attached along its top side 132 to the bottom face 116 of SRS 106 and along its bottom side 134 to magnet assembly 104. Suspension member 112 may be attached to an area of bottom face 116 which is outside of coil 108 and near the edge of SRS 106 as illustrated in FIG. 1B, which shows a plan view of the bottom face 116 of SRS 106 along line 1-1' of FIG. 1A. As further illustrated in FIG. 1B, suspension member 112 may be a continuous structure which acoustically seals SRS 106 to magnet assembly 104 such that the area below SRS 106 is acoustically isolated from the area above SRS 106. In this aspect, sound waves produced by bottom face 116 of SRS 106 are not directed out of acoustic port 120. In other embodiments, suspension member 112 may be made of discrete units (see, for example, suspension member 312A of FIG. 3B). In either case, suspension member 112 may be attached to SRS 106 in any suitable manner, such as, for example, an adhesive, laser welding, a thermoforming technique or the like.

Figure 1C:
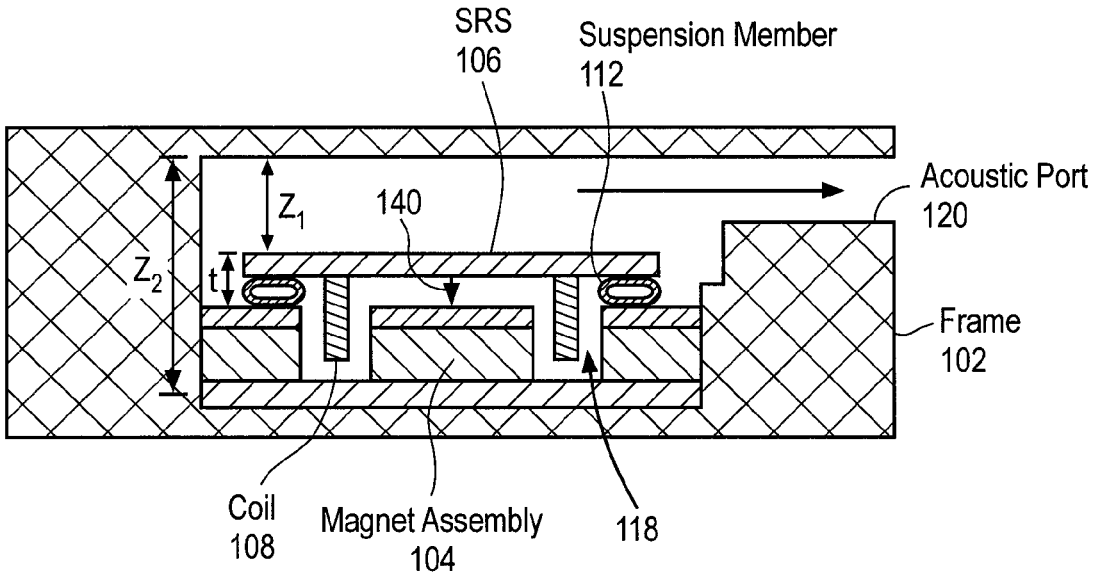
FIG. 1C is a cross-sectional side view of the speaker assembly of FIG. 1A having a compressed suspension member.

Representatively, in some embodiments, suspension member 112 may be made of a hollow tube which can expand or contract in the z-height direction. Representatively, FIG. 1A illustrates a tubular suspension member 112 having a thickness (t) (or z-height) which is substantially equivalent to a distance between the bottom face 116 of SRS 106 and the magnet assembly 104. In FIG. 1A, the tubular suspension member 112 is not compressed or contracted. Rather, the tubular suspension member 112 is in its resting state. As illustrated by FIG. 1C, however, as SRS 106 moves in the direction of magnet assembly 104 (as illustrated by arrow 140) the tubular suspension member 112 is compressed and its overall thickness decreases. The tubular suspension member 112 will in turn expand back to its resting state (i.e. the thickness will increase) when SRS 106 moves away from magnet assembly 104. Although suspension member 112 is illustrated as having a substantially square cross-sectional shape, suspension member 112 may have any cross-sectional shape, for example, a substantially round, rectangular, concave, or convex shape.

Figure 2:
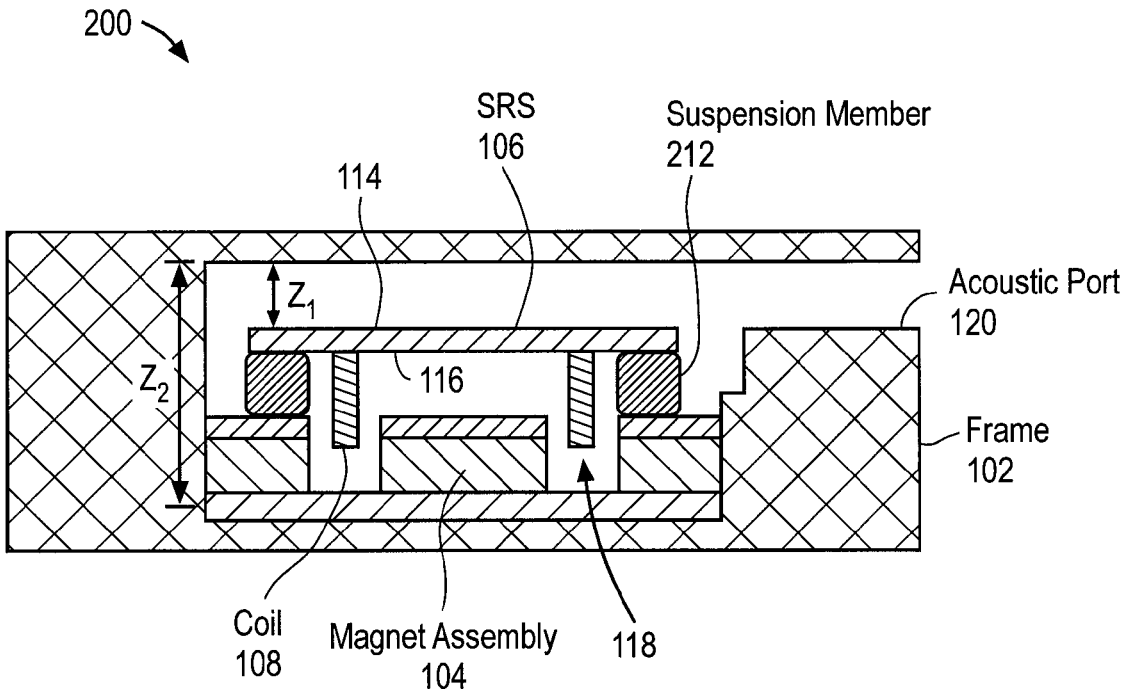
FIG. 2 is a cross-sectional side view of one embodiment of a speaker assembly.

FIG. 2 illustrates a cross-sectional side view of another embodiment of a speaker assembly in which suspension member 212 is substantially similar to suspension member 112 except that in this embodiment, suspension member 212 is made of a substantially solid structure. Representatively, suspension member 212 may be a solid elongated structure which is made of a resilient material which allows for suspension member 212 to expand and contract in the z-height or thickness direction in response to movement of SRS 106. Suspension member 212 may be made of one material, or a composite structure made of several materials. For example, suspension member 212 could be made entirely of a silicon or rubber material, or could include an outer portion made of one of these materials and an inner portion made of another of these materials, or a gel material. Similar to the previously discussed suspension member 112, suspension member 212 is confined to an area below SRS 106 and within a footprint of SRS 106 such that it does not extend radially beyond the bounds of SRS 106. Similar to speaker assembly 100, because suspension member 212 is confined to an area below SRS 106, speaker assembly 200 has a relatively low $Z_1$ to $Z_2$ height ratio, for example, a $Z_1$ to $Z_2$ ratio of from about 1 to 4, or from 1 to 3, or 1 to 2. Speaker assembly 200 may be substantially similar to speaker assembly 100 and, therefore, also includes frame 102, SRS 106, coil 108 and magnet assembly 104. Suspension member 212 may be attached around the bottom face 116 of SRS 106 in a similar manner to those previously discussed in reference to FIG. 1A (e.g., an adhesive, laser welding, a thermoforming technique or the like).

Figure 3A:
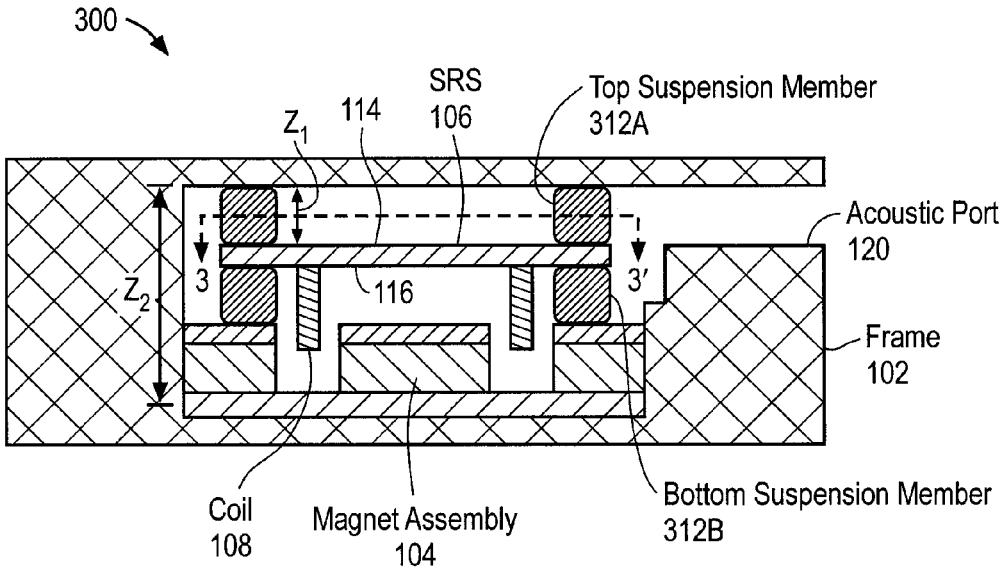
FIG. 3A is a cross-sectional side view of one embodiment of a speaker assembly.
Figure 3B:
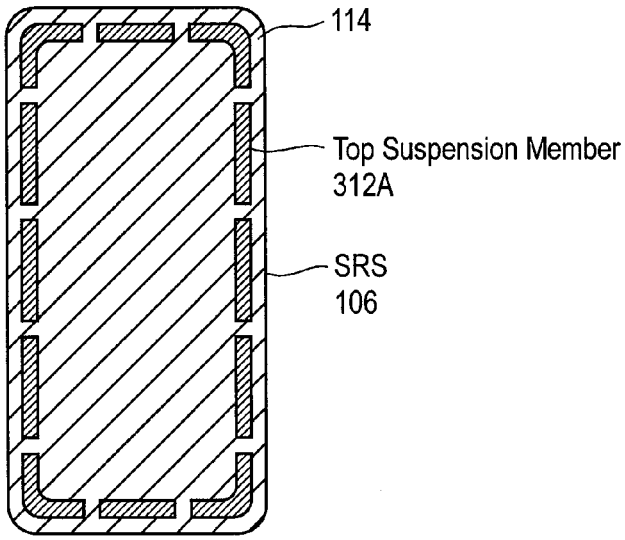
FIG. 3B is a top plan view of the sound radiating surface of one embodiment of the speaker assembly along line 3-3' of FIG. 3A.

FIG. 3A illustrates a cross-sectional side view of another embodiment of a speaker assembly. In this embodiment, speaker assembly 300 includes a dual suspension member system. Representatively, speaker assembly 300 includes a top suspension member 312A attached to top face 114 of SRS 106 and a bottom suspension member 312B attached to bottom face 116 of SRS 106. Top suspension member 312A is attached at its top side to frame 102 and its bottom side to top face 114 of SRS 106. In addition, similar to the previously discussed suspension members, bottom suspension member 312B is attached at its top side to bottom face 116 of SRS 106 and its bottom side to magnet assembly 104. Top suspension member 312A and bottom suspension member 312B may be substantially similar in material and structure to the suspension members previously discussed in reference to FIG. 1A and FIG. 2, except that in this embodiment one of them may be continuous while one of them may be made of discrete units. Representatively, bottom suspension member 312B may be made of a continuous structure such as a tubular member that seals SRS 106 to magnet assembly 104. Top suspension member 312A may be made of discrete units as illustrated in FIG. 3B, which is a top plan view of top face 114 of SRS 106 along line 3-3' of FIG. 3A. In this aspect, sound generated by SRS 106 can travel from top face 114 and out the side acoustic port 120 formed in frame 102. In addition, it is further to be understood that top suspension member 312A may have a thickness sufficient to fill the gap between the top side of frame 102 and top face 114 of SRS 106 without substantially increasing the z-height (i.e. $Z_1$) of frame 102. In this aspect, speaker assembly 300 has a relatively low $Z_1$ to $Z_2$ height ratio as previously discussed (e.g. a $Z_1$ to $Z_2$ ratio of from about 1 to 4, or from 1 to 3, or 1 to 2). The remaining components of speaker assembly 300 may be substantially similar to those previously discussed in reference to FIG. 1A. Representatively, speaker assembly 300 further includes coil 108 suspended from SRS 106 and magnet assembly 104 mounted within frame 102, below SRS 106 and coil 108.

Figure 4:
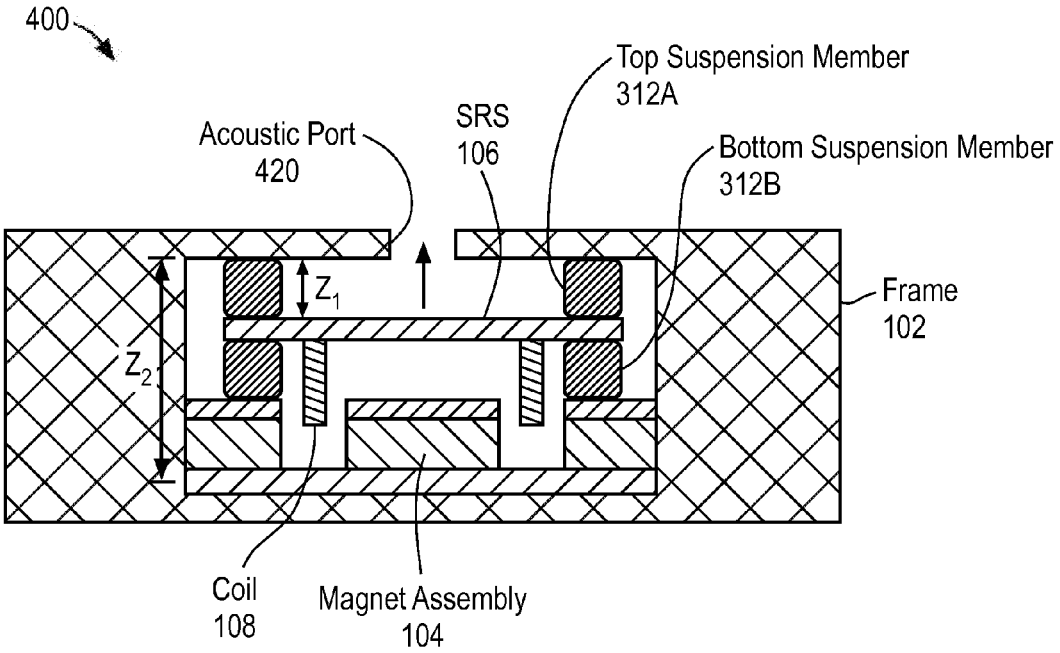
FIG. 4 is a cross-sectional side view of another embodiment of a speaker assembly.

FIG. 4 illustrates another embodiment of a speaker assembly. Speaker assembly 400 is substantially similar to speaker assembly 300 described in reference to FIG. 3A except in this embodiment, speaker assembly 400 is a "top firing" speaker system which includes acoustic port 420 along a top side of frame 102. In this aspect, sound generated by SRS 106 is output through a top side of frame 102. Since the sound need not travel through the top suspension member 312A to any of the previously discussed side acoustic ports, top suspension member 312A can be made of a continuous structure which seals SRS 106 to frame 102. Bottom suspension member 312B may also be a continuous structure as previously discussed, or may be made of discrete units since the area above SRS 106 is already acoustically isolated from the area below SRS 106 by top suspension member 312A. Although two suspension members 312A and 312B are illustrated in FIG. 4, it is contemplated that the "top firing" speaker system may also be formed using only one suspension member, e.g., bottom suspension member 312B, and the other omitted.

Figure 5:
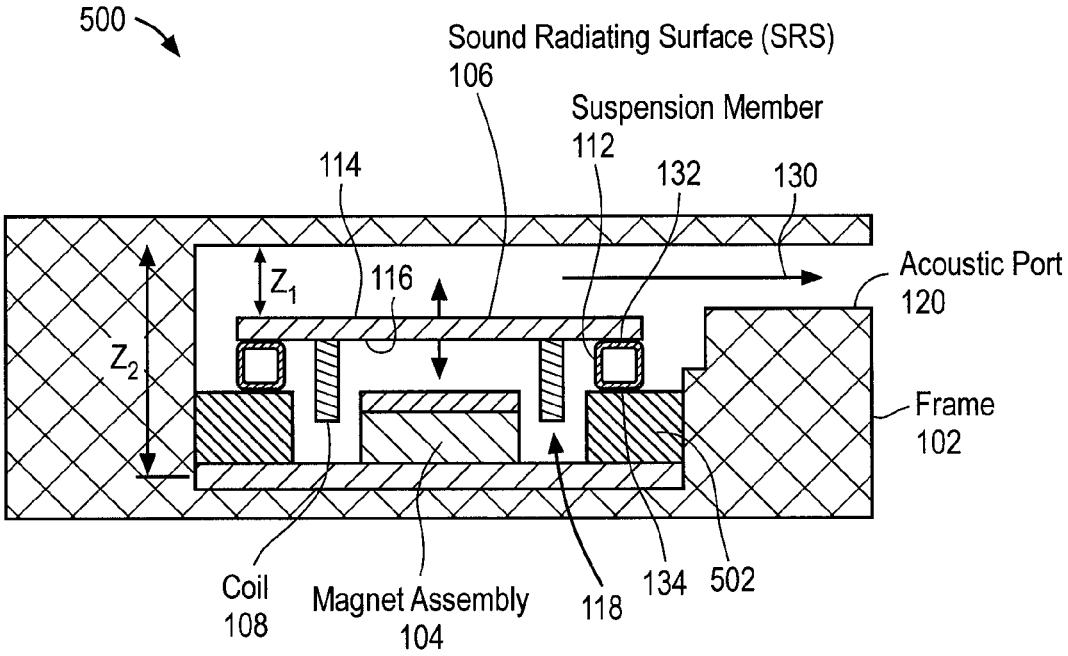
FIG. 5 is a cross-sectional side view of another embodiment of a speaker assembly.

FIG. 5 is a cross-sectional side view of another embodiment of a speaker assembly. Speaker assembly 500 is substantially similar to speaker assembly 100 described in reference to FIG. 1A and therefore includes similar features, for example, frame 102, SRS 106, coil 108, suspension member 112, magnet assembly 104 and acoustic port 120. In this embodiment, suspension member 112 is positioned between a bottom face 116 of SRS 106 and a support member 502. Representatively, the top side 132 of suspension member 112 may be attached to the bottom face 116 of SRS 106 and the bottom side 134 of suspension member 112 may be attached to support member 502. The support member 502 may be, for example, any type of structure and/or material capable of supporting suspension member 112 in a manner which allows suspension member 112 to suspend SRS 106 within frame 102 and above magnet assembly 104. Suspension member 112 may be dimensioned to extend vertically in a direction (i.e. in the z-height direction) away from the bottom face of SRS 106 toward support member 502, and magnet assembly 104 as discussed in previous embodiments. In some embodiments, support member 502 is a separate structure than magnet assembly 104. In some cases, support member 502 may be made of a different material than magnet assembly (e.g. a non-ferrous material). Representatively, magnet assembly 104 of FIG. 5 may be a center type magnet assembly which is confined to an area within coil 108. Support member 502 may be positioned within the area outside of coil 108. Support member 502 may be, for example, a plastic structure which is mounted within frame 102, or part of frame 102, and dimensioned to support suspension member 112 along its bottom side 134. For example, support member 502 may be an integral part of frame 102 in that it is manufactured during the same processing steps used to make the frame, e.g., same molding and machining steps).

It is to be understood that although not described in great detail in reference to FIG. 5, each of frame 102, SRS 106, coil 108, suspension member 112 and acoustic port 120 are substantially similar to, and operate in a similar manner to, those discussed in reference to FIG. 1A therefore the description of FIG. 1A with respect to these elements applies to FIG. 5. It is further to be understood that a support member 502 may be implemented in any of the speaker assembly embodiments illustrated in, for example, FIG. 1A, FIG. 2, FIG. 3A and FIG. 4.

A process of manufacturing any one or more of the speaker assemblies described above, and in particular a speaker assembly including a frame 102, magnet assembly 104, SRS 106, coil 108 and one or more suspension members 112, 212, 312A-312B may proceed as follows. Coil 108 may be obtained as a pre-wound unit, which is then secured to SRS 106. Next, the magnet assembly 104 is mounted within frame 102 and, at the same time, or just before or just after, the suspension member (for example, suspension member 112) is attached to magnet assembly 104. Alternatively, the suspension member may first be attached to SRS 106. SRS 106, which may be a rigid plate or dome having coil 108 attached thereto, is then attached to a top side of the suspension member.

As previously discussed, FIG. 6 illustrates exemplary consumer electronic devices 602 and 606 within which any of the previously discussed speaker assemblies may be implemented. In this aspect, an acoustic output port of any of the previously discussed speaker assemblies may be aligned with an acoustic opening of the portable audio device such that sound generated by the speaker assembly may be output from the portable audio device. These, however, are just two examples of where the speaker assembly may be used. Other types of devices within which the speaker assembly may be used may include, but are not limited to, a notebook computer or other portable computing device, a digital media player, such as a portable music and/or video media player, entertainment systems or personal digital assistants (PDAs), or general purpose computer systems, or special purpose computer systems, or an embedded device within another device, or cellular telephones which do not include media players, or devices which combine aspects or functions of these devices (e.g., a media player, such as an iPod®, combined with a PDA, an entertainment system, and a cellular telephone in one portable device).

Figure 7:
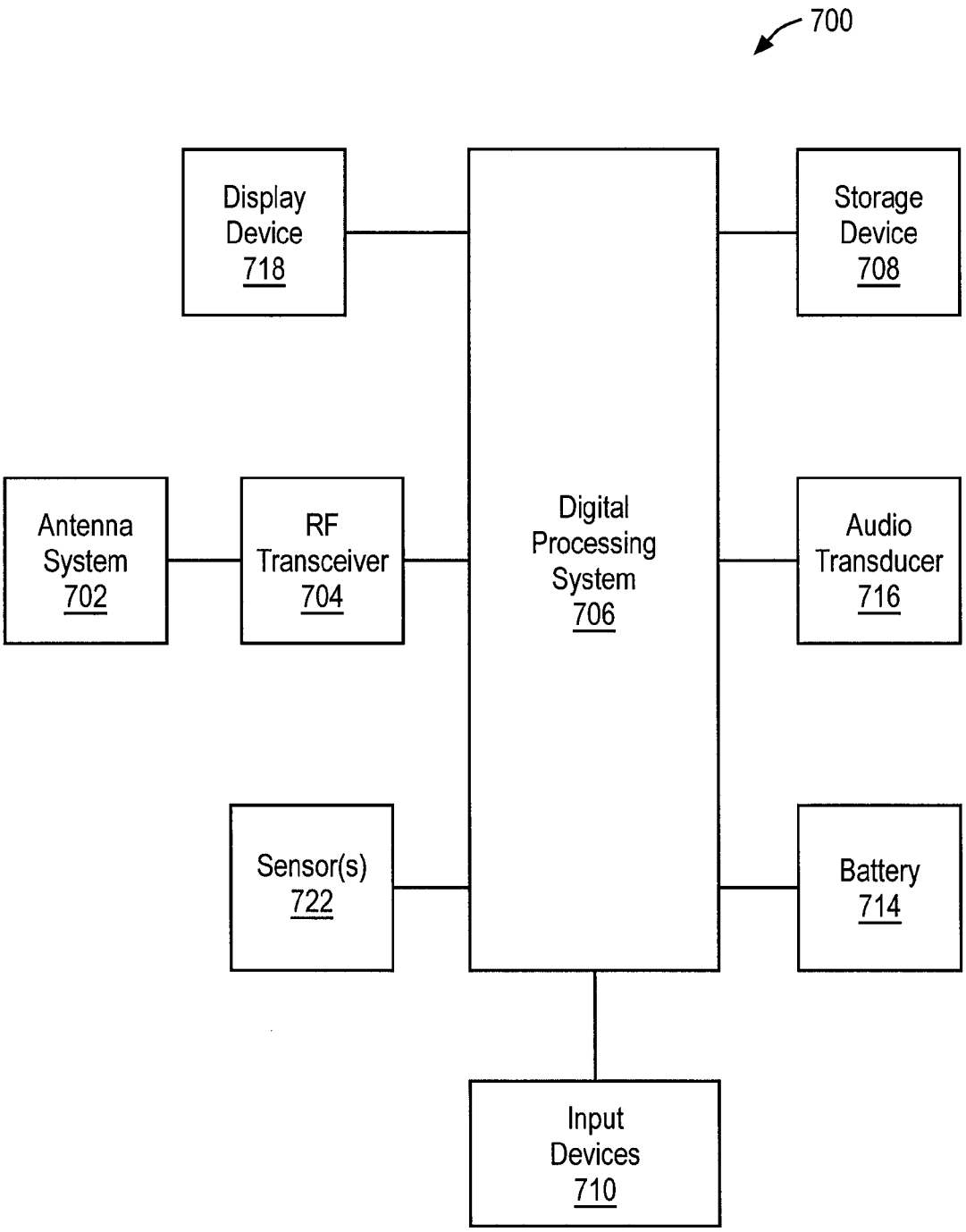
FIG. 7 is a block diagram of a system in which embodiments of a speaker assembly may be implemented.

FIG. 7 shows a block diagram of an embodiment of a wireless device 700 within which any of the previously discussed speaker assemblies may be implemented. In the illustrated embodiment, wireless device 700 is a wireless communication device. The wireless device 700 may be included in the devices shown in FIG. 6, although alternative embodiments of handheld devices 602 and 606 may include more or fewer components than the wireless device 700.

Wireless device 700 may include an antenna system 702. Wireless device 700 may also include a radio frequency (RF) transceiver 704, coupled to the antenna system 702, to transmit and/or receive voice, digital data and/or media signals through antenna system 702.

A digital processing system 706 may further be provided to control the digital RF transceiver and to manage the voice, digital data and/or media signals. Digital processing system 706 may be a general purpose processing device, such as a microprocessor or controller for example. Digital processing system 706 may also be a special purpose processing device, such as an ASIC (application specific integrated circuit), FPGA (field-programmable gate array) or DSP (digital signal processor). Digital processing system 706 may also include other devices to interface with other components of wireless device 700. For example, digital processing system 706 may include analog-to-digital and digital-to-analog converters to interface with other components of wireless device 700.

A storage device 708, coupled to the digital processing system, may further be included in wireless device 700. Storage device 708 may store data and/or operating programs for the wireless device 700. Storage device 708 may be, for example, any type of solid-state or magnetic memory device.

One or more input devices 710, coupled to the digital processing system 706, to accept user inputs (e.g., telephone numbers, names, addresses, media selections, etc.) or output information to a far end user may further be provided. Exemplary input devices may be, for example, one or more of a keypad, a touchpad, a touch screen, a pointing device in combination with a display device or similar input device.

Display device 718 may be coupled to the digital processing system 706, to display information such as messages, telephone call information, contact information, pictures, movies and/or titles or other indicators of media being selected via the input device 710. Display device 718 may be, for example, an LCD display device. In one embodiment, display device 718 and input device 710 may be integrated together in the same device (e.g., a touch screen LCD such as a multi-touch input panel which is integrated with a display device, such as an LCD display device). It will be appreciated that the wireless device 700 may include multiple displays.

Battery 714 may further be provided to supply operating power to components of the system including digital RF transceiver 704, digital processing system 706, storage device 708, input device 710, audio transducer 716, sensor(s) 722, and display device 718. Battery 714 may be, for example, a rechargeable or non-rechargeable lithium or nickel metal hydride battery. Wireless device 700 may also include audio transducers 716, which may include one or more speakers (e.g. speaker assemblies 100-400), receivers and at least one microphone.

Sensor(s) 722 may be coupled to the digital processing system 706. The sensor(s) 722 may include, for example, one or more of a light and/or proximity sensor. Based on the data acquired by the sensor(s) 722, various responses may be performed automatically by the digital processing system, such as, for example, activating or deactivating the backlight, changing a setting of the input device 710 (e.g., switching between processing or not processing, as an intentional user input, any input data from an input device), and other responses and combinations thereof. It is noted that other types of sensors may also be included in wireless device 700, such as an accelerometer, touch input panel, ambient noise sensor, temperature sensor, gyroscope, a hinge detector, a position determination device, an orientation determination device, a motion sensor, a sound sensor, a radio frequency electromagnetic wave sensor, and other types of sensors and combinations thereof.

In addition, although not illustrated, other types of devices and/or components may also be associated with wireless device 700, for example, a camera.

While certain embodiments have been described and shown in the accompanying drawings, it is to be understood that such embodiments are merely illustrative of and not restrictive, and that the embodiments disclosed herein are not limited to the specific constructions and arrangements shown and described, since various other modifications may occur to those of ordinary skill in the art. For example, although the drawings show a substantially rectangular SRS, it is contemplated that SRS may have any shape and size suitable for use in a speaker assembly, for example, SRS may be round. In addition, although the speaker assembly is described as a micro-speaker assembly, it is further contemplated that suspension members such as those described herein may be used to suspend any type of diaphragm used in any type of speaker assembly, for example, a diaphragm used in high fidelity speaker systems for stereo systems, radios, televisions or the like. The description is thus to be regarded as illustrative instead of limiting.

What is claimed is:

1. A speaker driver comprising:

a frame;

a magnet assembly positioned within the frame;

a sound radiating surface suspended over the magnet assembly, the sound radiating surface having a top face and a bottom face, and wherein the bottom face faces the magnet assembly;

a suspension member for suspending the sound radiating surface over the magnet assembly, the suspension member having a top side connected to the bottom face of the sound radiating surface and a bottom side connected to a support member, and wherein the top side and the bottom side of the suspension member define a thickness of the suspension member, and the thickness of the suspension member is modifiable in a z-height direction; and a voice coil extending from the bottom face of the sound radiating surface.

2. The speaker driver of claim 1 wherein the suspension member comprises a resilient material configured to compress and expand in the z-height direction in response to a movement of the sound radiating surface.

3. The speaker driver of claim 1 wherein the suspension member comprises a resilient tube.

4. The speaker driver of claim 1 wherein the suspension member is configured to acoustically seal the sound radiating surface to the magnet assembly.

5. The speaker driver of claim 1 wherein the suspension member is a first suspension member, and the speaker driver further comprises a second suspension member connected to a top face of the sound radiating surface and the frame.

6. The speaker driver of claim 1 wherein the suspension member is a) confined to an area within a footprint of the sound radiating surface or b) does not extend radially beyond an outer perimeter of the sound radiating surface.

7. The speaker driver of claim 6 wherein the support member is an integral part of the frame.

8. The speaker driver of claim 1 wherein the support member is a separate structure from the magnet assembly and is made of a different material than the magnet assembly.

9. A micro-speaker assembly comprising:

a frame;

a magnet assembly positioned within the frame;

a sound radiating surface suspended over the magnet assembly, the sound radiating surface having a top face and a bottom face, and wherein the bottom face faces the magnet assembly;

a suspension member for suspending the sound radiating surface over the magnet assembly, wherein the suspension member extends in a z-height direction from the bottom face of the sound radiating surface toward a support member, and wherein the suspension member comprises a top side attached to the bottom face of the sound radiating surface and a bottom side, and wherein the top side and the bottom side are aligned in the z-height direction and confined to an area below the bottom face of the sound radiating surface; and a voice coil extending from the bottom face of the sound radiating surface.

10. The micro-speaker assembly of claim 9 wherein the suspension member is configured to compress or expand along the z-height direction in response to movement of the sound radiating surface.

11. The micro-speaker assembly of claim 9 wherein the suspension member does not extend radially beyond a perimeter of the sound radiating surface.

12. The micro-speaker assembly of claim 9 wherein the suspension member comprises a hollow tube that seals the sound radiating surface to the magnet assembly.

13. The micro-speaker assembly of claim 9 wherein the magnet assembly is a center magnet confined to an area within the voice coil.

14. The micro-speaker assembly of claim 9 wherein the z-height is a first z-height corresponding to a distance between the sound radiating surface and a top of the frame and the micro-speaker assembly further comprises a second z-height corresponding to a distance between the top of the frame and a bottom of the frame, and wherein a ratio of the first z-height to the second z-height is less than 1 to 4.

15. A portable audio device comprising:

an outer case having a speaker associated acoustic hole formed therein; and a speaker assembly positioned within the outer case and acoustically coupled to the speaker associated acoustic hole, the speaker assembly having a diaphragm, a voice coil, and a magnet assembly, wherein the diaphragm is suspended over the magnet assembly by a suspension member that extends in a z-height direction away from a bottom face of the diaphragm and toward a support member within the outer case, and wherein the suspension member comprises a thickness that is modifiable in the z-height direction.

16. The portable audio device of claim 15 wherein an acoustic radiation surface area of the diaphragm substantially overlaps the suspension member.

17. The portable audio device of claim 15 wherein the suspension member is connected to a portion of a bottom face of the diaphragm surrounding the voice coil.

18. The portable audio device of claim 15 wherein the suspension member comprises a resilient material that forms a seal between the diaphragm and the magnet assembly.

19. The portable audio device of claim 15 wherein the suspension member is a first suspension member, and the device further comprises a second suspension member comprising sections of a resilient material that are attached to a top face of the diaphragm.

20. The portable audio device of claim 15 wherein the speaker assembly is a side firing speaker assembly.

* * * * *